US008617666B2

(12) United States Patent
Van De Wall

(10) Patent No.: US 8,617,666 B2
(45) Date of Patent: Dec. 31, 2013

(54) METHOD FOR APPLYING ONE OR MORE LAYERS TO A PAPER SUBSTRATE

(75) Inventor: Wilhelmus Josephus Alex Van De Wall, Heeze (NL)

(73) Assignee: Trespa International B.V., Weert (NL)

( * ) Notice: Subject to any disclaimer, the term of this patent is extended or adjusted under 35 U.S.C. 154(b) by 380 days.

(21) Appl. No.: 12/160,461

(22) PCT Filed: Jan. 15, 2007

(86) PCT No.: PCT/NL2007/000013

§ 371 (c)(1),
(2), (4) Date: Jul. 10, 2008

(87) PCT Pub. No.: WO2007/081205

PCT Pub. Date: Jul. 19, 2007

(65) Prior Publication Data

US 2008/0292875 A1 Nov. 27, 2008

(30) Foreign Application Priority Data

Jan. 13, 2006 (NL) ..... 1030913

(51) Int. Cl.
*B05D 1/30* (2006.01)
*B05D 3/02* (2006.01)

(52) U.S. Cl.
USPC ..... 427/420; 427/372.2; 427/385.5; 427/496; 427/508

(58) Field of Classification Search
USPC ..... 427/420, 331, 372.2, 382, 385.5, 496, 427/508
See application file for complete search history.

(56) References Cited

U.S. PATENT DOCUMENTS

| | | | | |
|---|---|---|---|---|
| 3,940,538 | A * | 2/1976 | Palazzolo et al. | 428/322.2 |
| 4,789,604 | A * | 12/1988 | van der Hoeven | 428/503 |
| 6,099,913 | A * | 8/2000 | Clarke et al. | 427/420 |
| 6,660,370 | B2 * | 12/2003 | Vogels et al. | 428/215 |
| 2003/0087038 | A1 * | 5/2003 | Su et al. | 427/420 |
| 2003/0194501 | A1 * | 10/2003 | Urscheler et al. | 427/420 |
| 2004/0265542 | A1 * | 12/2004 | Yanagisawa et al. | 428/143 |
| 2006/0240247 | A1 * | 10/2006 | Haller | 428/335 |

FOREIGN PATENT DOCUMENTS

| | | | |
|---|---|---|---|
| CN | 1357668 | A | 7/2002 |
| CN | 1526043 | A | 9/2004 |
| GB | 1165222 | | 9/1969 |
| WO | WO02/084029 | | 10/2002 |
| WO | WO2005/009758 | | 2/2005 |

* cited by examiner

*Primary Examiner* — Alexander Weddle
(74) *Attorney, Agent, or Firm* — Roberts & Roberts, LLP

(57) ABSTRACT

The present invention relates to a method for applying two or more layers to a substrate by means of a multilayer curtain coating process. The present invention further relates to a decorative or a functional foil built up of a substrate and at least two coatings present thereon. The present invention further relates to a rigid panel, at least one of the layers of which is a decorative foil, which foil has been applied by means of a curtain coating method.

8 Claims, No Drawings

METHOD FOR APPLYING ONE OR MORE LAYERS TO A PAPER SUBSTRATE

The present invention relates to a method for applying two or more layers to a substrate by means of a multilayer curtain coating process, wherein a curtain comprising at least two layers of coating liquids is applied to a substrate, which substrate is moved in a direction perpendicular to the curtain, after which the substrate thus provided with at least two liquid coatings is subjected to a curing step for curing the liquid coatings. The present invention further relates to a decorative or a functional foil built up of a substrate and one or more layers present thereon. The present invention further relates to a rigid panel, at least one of the layers of which is a decorative foil.

HPL panels and HPL compact panels according to EN 438 are examples of panel materials that are frequently used for applications that require scratch resistance, wear resistance, chemical resistance, graffiti resistance and colour fastness. To achieve these high surface properties, surfaces consisting of decorative papers and overlays impregnated with melamine resins, in some cases modified so as to further improve specific properties, have been successfully used for many years.

A well-known weakness of the melamine-impregnated papers is their limited resistance to acids, and especially their limited weather resistance, which render the panels unsuitable for applications in which the materials are expected to serve a decorative purpose even after several years of outdoor use.

From U.S. Pat. No. 4,927,572 there is known a method for producing a decorative foil for refining panel materials that eliminates the above drawbacks. The weather resistance has been significantly improved by making use of components that have additionally been subjected to a thermal treatment after radiation curing.

The method as referred to in the introduction is known per se from European patent application EP 1 375 014. According to the method of curtain coating that is known therefrom, a thin liquid film is applied via a slit construction to an underlying substrate over substantially the entire width thereof whilst the substrate is being moved in a direction transversely to the liquid film. Thus a continuously flowing liquid curtain is effected between the slit construction and the underlying substrate, as it were, and a liquid film is formed on said substrate as a result of the force of gravity and the movement of the substrate. According to the curtain coating method it is thus possible to use a die that is positioned above the substrate, which die comprises a plurality of regularly spaced parallel slits, through which various liquids, viz. so-called coating, are passed, so that a plurality of superposed films are thus formed on the moving substrate. From said document it can only be derived that the substrate may be a paper web, a plastic foil or a metal foil. Such substrates, in particular the paper web, exhibit a limited moisture resistance and a limited split resistance, and they are difficult to glue to materials that are subjected to mechanical, thermal and chemical loads, such as High Pressure Laminates (HPL), Low Pressure Laminates (LPL); compact panels and other panel materials.

From International application WO 2005/005705 it is known to use multilayer curtain coating for radiation-curable coatings that are used for refining textile fabrics. It is described in said patent publication that the use of this multilayer technique in combination with radiation-curable coatings, at least one coating liquid contains a fluorine containing group, makes it possible to apply several layers, each layer having a different functionality, and thus make the textile oil and water resistant.

From British patent GB 1,165,222 there is known a method for coating a cellulosic substrate with a thermosetting resin composition, comprising the application of a primer to the substrate by rolls, spray, brush or single-layer curtain coater, after which the primer-coated substrate is passed through a drying chamber for the purpose of removing the solvent from the primer. Following that, the substrate with the uncured primer is passed through a curing station, which employs infrared radiation for fully curing the primer. Then a top coat is applied over the thus cured primer, after which the assembly is passed through a drying chamber again, followed by complete curing through infrared radiation.

From European patent application No. 1 595 718 there is known a method for manufacturing a decorative laminate, wherein a polymer is applied to the surface of a substrate in a first process step, and subsequently the polymer layer thus applied is partially cured in a second process step, after which an overlay paper or a non-woven material is placed on the partially cured polymer layer. The assembly thus obtained is further processed under elevated temperature and pressure conditions, as a result of which the polymer layer is fully cured. To further improve the bond between the polymer layer and the substrate, a primer may first be applied to the substrate, after which the polymer layer is applied thereto.

The application of one or more layers to a substrate by means of a curtain coating process is also known from International application WO 01/70418, wherein a so-called multilayer, water-based release liner is formed, which consists of a backing, a support layer covering the backing, and finally a silicone-containing layer covering the support layer, wherein the silicone distribution in the underlying layer must meet specific requirements in order to function as an adhesion layer.

From International application WO 2005/009758 there is known a web-like decorative coating film consisting of a substrate film of paper and/or plastic material coated with a base layer of a radiation-curable resin, which base layer contains abrasive fillers, and a covering layer of a radiation-curable resin formed on the base layer, which covering layer does not contain abrasive fillers. Such a coating film is obtained by coating the substrate film with the liquid base layer first, subsequently drying the assembly thus obtained, using heat, and finally applying the liquid covering layer, after which joint curing of the covering layer and the base layer takes place by irradiation with UV and/or electron beams. Thus, two separate curing steps are required in order to eliminate the risk of intermixing of the individual layers. Applying more than two layers by means of the method that is known therefrom is very difficult and economically unattractive.

From U.S. Pat. No. 4,789,604 there is known a method for manufacturing a decorative layer wherein a foil exhibiting a defined degree of gloss is used for determining the final degree of gloss of a panel.

The present Applicant is the proprietor of U.S. Pat. No. 6,660,370, which discloses a method for making a coloured multilayer composite by applying at least two or more radiation-curable layers to flexible supporting layers and subsequently laminating the supporting layers to each other, with the radiation-curable layers abutting each other. In particular, two flexible supporting layers, each provided with a radiation-curable layer, are placed in contact with each other and, when pressed together, the coloured multilayer composite is obtained, and subsequently the radiation-curable layers are partially cured in a first step, using maximally 30% of the maximum dose of actinic radiation, after which one of the supporting layers is removed from the composite. Finally, full curing of the radiation-curable layer takes place in a second step. According to said method, it is in principle possible to obtain a coloured composite material comprising two radiation-curable layers, wherein a specified minimum thickness of the layers is required. In addition to that, such a method requires the use of at least two supporting layers, which are subsequently removed, which may adversely affect the surface of the radiation-curable layer. Moreover, faults and/or defects, for example air bubbles, occur in the radiation-curable layers in the disclosed examples, which is found to be undesirable in practice.

The object of the present invention is thus to provide a method for manufacturing a coloured, multilayer decorative or functional foil, wherein the above drawbacks are obviated.

Another object of the present invention is to provide a method for manufacturing a coloured, multilayer decorative or functional foil, wherein specific properties can be realised in each of the layers.

Another object of the present invention is to provide a method for manufacturing a multilayer decorative or functional foil, wherein thin layers may be used in the foil, thereby minimising the consumption of raw materials.

The present invention as referred to in the introduction is characterised in that the substrate is selected from the group consisting of impregnated paper, pre-impregnated paper, overlay paper, core paper, impregnable paper and liquid-absorbent paper.

One or more of the above objects can be achieved by using a substrate of such a type. In a number of embodiments the pre-impregnated paper has already been impregnated with resins, for example phenol resins, melamine resins, ureum resins, possibly radiation-curable resin mixtures of the aforesaid resins with polymer dispersions, or combinations thereof, by the paper manufacturer. A phenol resin is a suitable resin. The impregnated papers are impregnated with one or more of the aforesaid materials in an impregnating process separate from the paper making process. For a specific description of the substrate materials that can be used in the present invention reference is made to DIN 6730, "Papier und Pappe", November 2001, viz.: impregnable paper "Impragnierrohpapier" is an unsized paper prepared for impregnation, overlay paper is a "Laminatrohpapier" consisting of bleached pulp having a high degree of purity, unloaded and printable, core paper is "Kernrohpapier" that has already been impregnated with a resin, and liquid-absorbent paper is a paper type that is capable of absorbing and retaining liquid. Preferably, a paper impregnated with a resin is used as the impregnated or pre-impregnated paper, which resin may in part consist of a curing system, such as in particular a thermal curing system. A decor paper, in particular a decor paper which has at least partially been impregnated with a resin, preferably a phenol resin, and which may or may not be printed, can be used as a suitable substrate. Another substrate that is particularly suitable is an overlay paper that has been impregnated with a phenol resin. For specific applications it is possible to use a substrate which has not been impregnated prior to carrying out the multilayer curtain coating method for applying the at least two coatings.

According to the present invention it is in particular possible to apply several layers simultaneously to the substrate, with the total thickness of the applied layers varying from 10 to 150 micrometer and the thickness of the individual layers varying from 2 to 150 micrometer, in particular 2-30 micrometer, so that the substrate will have both a functional and an aesthetic value. The present method is in particular characterised in that the application of the at least two coatings on a substrate takes place simultaneously, without an intermediate drying step, wherein in particular one of the at least two coatings is free from solvent and/or from water.

The method of multilayer curtain coating is known per se and is used for applying a number of layers to a substrate. A coating device comprising a die for effecting the curtain consisting of a number of separate coating liquids is used for said multilayer curtain coating. The die comprises a plurality of slits or outflow openings for the coating liquid, which slits are arranged parallel to each other and which are positioned perpendicular to the direction of movement of the substrate to which the coating liquid(s) is (are) to be applied. It is preferable to remove air inclusions and any dissolved gases from the coating liquids as much as possible, for example by means of a vacuum, before the coating liquids are fed to the die. The length of the slit is substantially the same as the width of the substrate. The substrate, whose surface is to be coated with the coating liquid(s) that flow(s) from the die, is continuously transported under said die by conveyor means. By causing the liquid film, which exits the die in a free fall, to drop on the substrate that moves under said die, a substrate is obtained which is provided with a coating composed of a number of different coating liquids, which are supplied via the slits in the die. Because the slits are positioned one behind another, in spaced-apart relationship, seen in the direction of movement of the substrate, a multilayer liquid film will be developed in the die, which liquid film will already have the layer structure of the coating to be applied to the substrate that moves under the die upon exiting the die. The multilayer liquid film, which has been obtained as a result of the presence of several parallel outflow openings or slits, will land essentially vertically on the substrate that moves thereunder due to the force of gravity, with the liquid film forming a curtain between the substrate and the die. A stable curtain can be obtained by suitably setting the process parameters, whilst at the same time preventing inclusion of air and intermixing of the at least two coatings on the substrate. The liquid coating thus formed on the substrate, which, according to the present invention, consists of at least two layers, will subsequently be subjected to a curing treatment.

For the traditional binders it is prescribed that the viscosity of the lower most layer must not exceed 200-500 mPas at a high shearing rate (>1000 reciprocal second). In the case of prior art multilayer curtain coating, the substrate to which the layers are to be applied must be smooth and sealed, so that many different types of substrates are not suitable for use with this technique.

The application of several layers on top of each other moreover makes it possible to prevent defects in one of the individual layers from penetrating through the entire film. Each individual layer will inevitably comprise a small number of defects. Because several superposed layers are used, the risk of a defect in one of the layers coming into contact with a defect in a next layers is minimised. In this way the film can be sealed effectively, and the extent to which gases and liquids penetrate through the film can be minimised.

A suitable layer will be a resin, in particular a resin containing one or more functional groups that will cure under the influence of UV radiation and/or electron beam radiation (EB). The resins used in the present invention may also be partially cured by EB/UV radiation, with further curing taking place under the influence of an elevated temperature, moisture, oxygen or, if desired, of radiation of a type other than UV and/or EB radiation.

Because of the use of resins belonging to the group of radiation-curable resins and the special manner of application, in particular the curtain coating method, there is no need for an intermediate step for drying and/or curing the individual layers, which means a considerable saving in energy and costs. After all, because the layers are applied simultaneously to the substrate, the substrate provided with layers can subsequently be subjected to a single curing step, as a result of which the radiation-curable resins will cure. An advantage of the present method is that several layers may be applied without intermediate drying or curing of individual layers being required, and the layers may differ from each other as regards their composition and reology. Thus, several EB coatings or EB resins may be applied in a single process step, in which case even individual layer thicknesses of 2 μm are possible. Using the present method, the inventors have manufactured decorative or functional foils built up of five different layers.

According to the present invention it is in particular possible to obtain so-called defectless surfaces without bubbles and pinholes, whilst it is moreover possible to change the colour and/or the type of resin while carrying out the method, thus realising a highly flexible coating technology.

In a special embodiment of the present invention, it is desirable to apply an adhesion promoting layer, such as a primer, to the substrate as the first layer, viz. the base layer. Said first layer on the substrate may be used for simultaneously impregnating the substrate. The impregnation of paper has several technical advantages, viz. an improved fire retardation, moisture resistance, glueability, impact resistance and split resistance. The base layer may also function to protect the substrate against UV radiation, or to mask the colour of the substrate. Simultaneously therewith, one or more other layers are applied, which layers may comprise radiation-curable products and which may or may not contain additives, for example fire retardants, pigments, UV absorbents, metal whiskers, biocides, bacteriostatic agents, antistatic agents, self-cleaning agents, scratch resistance enhancers, fluorine-containing agents, silicone-containing agents, matting agents, chemical resistance enhancers and liquefiers. Furthermore it is possible to use IR reflecting agents, electrically conductive agents and adhesion promoters. It is moreover possible to use so-called effect pigments, for example aluminium flakes, mica pigments in order to realise special aesthetic effects. It is for example possible to use as the top layer a layer that exhibits excellent chemical and weather resistance properties. To influence the gloss level of the final product, a transparent top coat layer may be used as the outer layer, for example a water-based or a solvent-based top coat, without the final product properties of the composite being adversely affected. Finally it is possible to apply a very thin top layer so as to obtain specific textures or structures In a special embodiment of the present invention, the viscosities of the resins to be applied vary from 200 to 3000 mPas, measured at a shearing rate of 1000 $sec^{-1}$. The aforesaid viscosity values apply at the application temperature, viz. in a range of 10-70° C. The production rate of the substrate ranges between 50 and 400 m/min. Preferably, doses of 4 to 60 kGray and voltages of 80 to 300 kV are used for the EB step. The present inventors have succeeded in applying a base layer having a viscosity of 1200 mPas at 1000 $sec^{-1}$ to the substrate. Surprisingly, such low values have not resulted in an undesirably increased crosslinking density and the related embrittlement of the product properties. With such a high viscosity it is possible to limit the amount of reactive diluents in the formulation of the coatings, as a result of which the embrittlement and shrinkage connected with the addition of the reactive diluents can be reduced. The high processing temperature thus provides possibilities for further improvement of the product properties of the final product.

Examples of radiation-curable layers are $C_1$-$C_6$-alkyl acrylates and/or methacrylates, in particular methyl acrylate or ethyl acrylates and/or methacrylates. The radiation-curable acrylates are also oligomers acrylated with the aforesaid acrylates and acrylated molecules. After curing, the radiation-curable resin is composed of an oligomer selected from the group consisting of an epoxy (meth)acrylate, a silicone (meth)acrylate, a polyester (meth)acrylate and a urethane (meth)acrylate, or a combination thereof. An example of a resin-impregnated paper is a phenol resin-impregnated paper, in particular decor paper or overlay paper, which may or may not be printed. The top layers used in the present application are free from added halogen compounds, in particular fluorine-containing groups.

The present invention further relates to a decorative or functional foil built up of a substrate with two or more layers superposed thereon, characterised in that at least two layers have a thickness in the range of 2-30 μm, wherein in particular at least one of the layers comprises radiation-curable components. In a special embodiment of the present decorative foil, at least one of the layers has a thickness in the range of 5-20 μm, which decorative foil may be used as a furniture foil in a special embodiment.

In a special embodiment, the aforesaid decorative or functional foil may be applied as a so-called decorative coating to panels, made from layers of paper of saturated with phenol resins, ureum resins, isocyanate resins, melamine resins or combinations thereof, or of wood, plastic material, resin-saturated, pre-densified wood fibres and the like, so as to form panels for indoor as well as for outdoor use, which are resistant to weather influences. The production of such panels takes place at a temperature in the range of 120-210° C., a pressure in the range of 10-100 bar and a residence time in the press of 1-30 minutes.

The present invention will be explained below by means of a number of examples, in which connection it should be noted, however, that the present invention is by no means limited to such special examples.

In the examples below, use has been made of a number of machines which are described in more detail herein, the description of such equipment must not be construed as being limitative, however. The impregnation of paper was carried out with an impregnating machine from VITS of Rheinfelden (Germany). The curtain coating unit was a multilayer curtain coater from Polytype Converting, Fribourg, CH. Irradiation was carried out with a broadbeam-type EBC unit from the RPC company (Wisconsin, USA). The irradiating machine and the curtain coating unit were incorporated in a pilot line from Polytype, Fribourg, CH. In the examples in which mention is made of a phenol-resol resin for impregnated in the papers, use was made of a phenol resin produced by the inventors. Said phenol resins were prepared from phenol, formaldehyde and a catalyst, such as sodium hydroxide. The resins are standard, alkaline catalysed, water-based phenol-formaldehyde resins. A usual resin weight on paper amounts to 45-60% and the final moisture content is 4-8%.

In the paper selection, the inventors used the following papers.

- Decor paper: type Arjo Wiggins, 80 gsm black, Arjo Wiggins, Issy-les-Moulineux (F).
- Pre-impregnate: type Arjo-light, Arjo Wiggins, Issy-les-Moulineux (F).
- Overlay paper: Crompton 40 gsm liquid overlay, Crompton Ltd, Gloucestershire, UK.
- Core paper: saturating kraft, Gurley 25, MeadWestvaco, Glenn Allen (USA).

Printed decor paper: 80 gsm Alfa paper, Chiyoda Europe, Genk (B).

Unless otherwise stated, the papers used in the examples were impregnated with the above-described water based phenol formaldehyde resins. The following raw materials were used for coating in the examples:

oligomers such as epoxy acrylate, polyester acrylate, Ebecryl 284, urethane acrylate from Cytec Surface Specialties, Drogenbos, Belgium. Reactive diluents such as HDDA, TMPTA, TPGDA from Cytec Surface Specialties, Drogenbos, Belgium. Titanium dioxide from Kronos, Leverkusen, Germany. Carbon black from Degussa, Leverkusen, Germany. Aluminium flakes from Eckart, Germany. HALS, type Tinuvin HALS from Ciba Geigy, Basel, Switzerland. UV-absorbent, Tinuvin UV-absorbent from Ciba Geigy, Basel, Switzerland.

EXAMPLE 1

A device for applying layers by curtain coating was used, wherein two outflow openings of the device, viz. slit-shaped channels extending the width of the substrate, were used for applying two layers simultaneously to a substrate, viz. a black-pigmented, radiation-curable coating (type urethane acrylate), and a transparent coating. The production of such panels takes place by pressing a stack of the aforesaid layers together, using a pressure of 10-100 bar, a temperature of 120-210° C. and a treatment time of 1-30 minutes (type urethane acrylate). The coatings had a viscosity of about 2000 mPas at a temperature of 20° C. and a shearing rate of 1000 $sec^{-1}$ and were applied at a temperature of 40° C. The rate of movement of the substrate was 105 m/min and the coating weight of the black coating was 50 micrometer, whilst the coating weight of the transparent coating was 30 micrometer. A smooth phenol-resol-impregnated paper was used as the substrate. The substrate thus obtained was provided with a liquid film built up of a layer of the black coating and the overlying transparent coating, and the 100% solid matter coatings were cured simultaneously by means of EB, using a dose of 60 kGray and a voltage of 225 kV. The resulting decorative material did not exhibit any surface defects such as pinholes or air bubbles after curing. The decorative material thus obtained was used for producing a high-pressure laminate (HPL) compact panel, and the pressing step was carried out by placing the decorative material on a stack of phenol resin-impregnated, pre-densified fibre panels, so-called prepregs, at a pressure of about 60 bar and a temperature of about 140° C. for a period of about 30 minutes. The decorative panel thus obtained exhibited an excellent resistance to weather influences and very good surface properties. On account of the defectless coating technique, viz. the method of curtain coating, the properties of the decorative panels thus obtained were excellent in comparison with the HPL panels that are currently commercially available.

Standard black decor paper 80 $g/m^2$ from Arjo Wiggins, impregnated with phenol formaldehyde resin to a resin weight of 58% and a moisture content of 6%.

Layer 1: Urethane acrylate from Cytec Surface Specialties Ebecryl 284 with 3% Carbon black dispersed therein. Brought to the required processing viscosity with TMPTA.

Layer 2: Urethane acrylate from Cytec Surface Specialties Ebecryl 284, brought to the required viscosity level with HDDA. To this 1% HALS Tinuvin from Ciba was added. Layer 1 is in direct contact with the substrate.

EXAMPLE 2

The same device as in Example 1 was used, in this example, however, three layers, to be cured by radiation, were applied simultaneously to a substrate: the base layer, i.e. the layer to be applied directly to the substrate, being a composition having a grey colour and a viscosity of 900 mPas (at a shearing rate of 1000 $sec^{-1}$) at a temperature of 40° C., the intermediate layer being a composition having a grey metallic colour and a viscosity of 1100 mPas (at a shearing rate of 1000 $sec^{-1}$) at a temperature of 40° C., and the top layer being a transparent top coat having a viscosity of 630 mPas (at a shearing rate of 1000 $sec^{-1}$) at a temperature of 40° C. A smooth phenol-resol-impregnated paper was used as the substrate. The layer thickness of the base layer varied from 20 to 60 micrometer, the layer thickness of the intermediate layer varied from 30 to 60 micrometer, and the layout thickness of the top layer was maintained at 27 micrometer. The rate of movement of the substrate was 75 m/min. The coatings thus applied were cured by means of EB, using a dose of 60 kGray and a voltage of 225 kV. The resulting decorative foil was used for producing HPL compact panels, as explained in Example 1. The metallic appearance was special. The aluminium particles in the metallic coating were correctly oriented, and no defects such as blistering and striation were observed. The resistance to weather influences of the resulting panels was excellent. The panels scored a grey scale of 4 after exposure to a Florida simulation according to TRICS 7354, based on ISO 4892, 3000 hours. Standard black printable decor paper of 80 $g/m^2$ from Arjo Wiggins, impregnated with phenol formaldehyde resin with a resin weight of 58% and a moisture content of 6%.

Layer 1: Polyester acrylate Ebecryl from Cytec Surface Specialties with 3% Carbon black and 20% titanium dioxide dispersed therein. Brought to the required processing viscosity with TMPTA.

Layer 2: Urethane acrylate from Cytec Surface Specialties with 10% aluminium flakes from Eckart stirred therein. Brought to the required viscosity level with HDDA.

Layer 3: Urethane acrylate from Cytec Surface Specialties Ebecryl 284, brought to the required viscosity level with HDDA. To this 1% HALS from Ciba and 2% UV absorbent from Ciba was added.

EXAMPLE 3

A printed decorative paper was used as the substrate, and two layers of a so-called transparent coating were applied, using the curtain coating method and device of Example 1. The base layer, which is in direct contact with the substrate, consisted of a binder comprising adhesion promoters having a viscosity of 250 mPas at a temperature of 40° C. and a shearing rate of 1000 $sec^{-1}$ so as to effect a rapid penetration of said coating into the paper. The top coating was a transparent coating, to the formulation of which UV absorbents and HALS had been added. The viscosity of the top coating was 680 mPas at a temperature of 40° C. and a shearing rate of 1000 $sec^{-1}$. The two individual layers were used in a total film thickness varying from 50 to 60 micrometer, and the rate of movement of the substrate was set at value varying from 60 to 175 m/min. Curing was carried out by means of EB, using a dose of 60 kGray and a voltage of 225 kV. No surface defects could be observed in the coated papers thus obtained. Excellent results were obtained with a weight of 30 $g/m^2$ for the base layer and a weight of 30 $g/m^2$ for the top layer. The HPL panels formed with the decorative foils thus obtained had excellent properties, in particular as regards delamination. The panels thus produced were capable of resisting a residence time of 8 hours in boiling water without delamination, and the adhesion of the coating to the substrate complied with class 1 in a so-called cross-hatch test.

Printed Alfa paper from Chiyoda, woodprint, not pre-impregnated.

Layer 1: Urethane acrylate from Cytec Surface Specialties Ebecryl 284. Brought to the required viscosity level with HDDA. Phenol formaldehyde resin Trespa was added as an adhesion promoter in an amount of 1%.

Layer 2: Urethane acrylate from Cytec Surface Specialties Ebecryl 284, brought to the required viscosity level with HDDA. To this 1% HALS from Ciba and 3% UV absorbent from Ciba was added.

EXAMPLE 4

The same device as in Example 1 was used, with two layers being applied simultaneously, viz. a white-pigmented, radiation-curable coating and a transparent coating containing nanoparticles. The nanocoatings, which had a viscosity of 2500 mPas at a temperature of 20° C. and a shearing rate of 1000 $sec^{-1}$, were applied at a temperature of 40° C. The rate of movement of the substrate was varied from 75 to 200 m/min, and the coating weight of the white-pigmented coating was varied from 30 to 60 micrometer, whilst the coating weight of the transparent coating was maintained at 40 micrometer. A phenol-impregnated paper was used as the substrate. A dose of 60 kGray and a voltage of 225 kV were used for the EB curing. The resulting decorative material did not exhibit any surface defects and was used for producing a HPL compact panels, in the conditions described in Example 1. The resulting decorative panel exhibited excellent mechanical properties and a good resistance to chemicals. The panel remained unaffected after a contact period of 24 hours with sulphuric acid (85%) and methylethyl ketone (MEK) according to a test based on EN 438, viz. a drop of test fluid under a petri dish at room temp.

Standard white decor paper 120 $g/m^2$ from Arjo Wiggins, impregnated with phenol formaldehyde resin to a resin weight of 45% and a moisture content of 6%.

Layer 1: Urethane acrylate from Cytec Surface Specialties Ebecryl 284 with 35% titanium dioxide dispersed therein. Brought to the required viscosity level with TMPTA.

Layer 2: Urethane acrylate from Cytec Surface Specialties Ebecryl 284 admixed with 30% nanocryl. Subsequently brought to the required viscosity level with HDDA.

EXAMPLE 5

The device of Example 1 was used, with two layers being applied simultaneously, viz. a white-pigmented, radiation-curable coating, 50 micrometer, 50% epoxy acrylate, 50% polyester acrylate from Cytec, with 30% titanium oxide dispersed therein, brought to a viscosity level (=1200 mPas at 1000 $sec^{-1}$, 40° C.) with TPGDA, and a transparent coating containing nanoparticles, 10 micrometer, urethane acrylate from Cytec Surface Specialties Ebecryl 284 admixed with 30% nanocryl. Subsequently brought to the required viscosity level (=1800 mPas at 1000 $sec^{-1}$, and 20° C.) with HDDA. The liquid coatings were applied at a temperature of 40° C. The rate of movement of the substrate was 120 m/min. The substrate was Arjo-light from Arjo Wiggins. A dose of 60 kGray and a voltage of 225 kV were used for the EB curing. In this way a foil was obtained that can be successfully glued onto MDF to obtain a split-resistant and moisture-resistant material. The final panel material has a high degree of gloss and a scratch resistance of more than 1 N.

EXAMPLE 6

The device of Example 1 was used, with two layers being applied simultaneously, viz. the same layers as in Example 1. A saturating kraft 25 S Gurley from MeadWestvaco impregnated with 60% phenol formaldehyde resin, moisture content 5.8%, was used as the substrate. All the process settings corresponded to those used in Example 1.

Produced in this way, the substrate appeared to coat at least 75 micrometer of the white coating required to obtain an adequate coating. Coating holes remain visible in unacceptable numbers in the decor. The panel properties at the higher coating level were comparable to the properties of the panels obtained in Example 1.

The invention claimed is:

1. A method for applying two or more layers to a substrate by means of a multilayer curtain coating process comprising the steps of: applying a curtain comprising at least two layers of coating liquids to a substrate, wherein the at least two layers of coating liquids comprise a base layer and a top layer, and which base layer is in direct contact with the substrate, which substrate is moved in a direction perpendicular to the curtain, wherein each of the coating liquids independently comprises a radiation-curable resin, each of the coating liquids has a viscosity of from 200-3000 mPas measured at a shearing rate of 1000 $sec^{-1}$, each of the coating liquids is free from solvent and from water, and wherein the applying of the at least two layers of coating liquids takes place simultaneously without an intermediate drying step, after which the substrate thus provided with at least two liquid coatings is subjected to a curing step for curing the liquid coatings, which curing step includes subjecting the substrate thus provided with the at least two liquid coatings to radiation so as to effect curing of the radiation-curable resin in each of the coating liquids, and wherein the substrate is selected from the group consisting of impregnated paper, pre-impregnated paper, overlay paper, core paper, impregnable paper and liquid-absorbent paper.

2. The method according to claim 1, wherein the substrate comprises an impregnated or pre-impregnated paper which is impregnated with a resin.

3. The method according to claim 2, wherein the impregnated or pre-impregnated paper is impregnated with a phenol resin.

4. The method according to claim 2, comprising an overlay paper impregnated with a phenol resin.

5. The method according to claim 1, wherein the radiation-curable resin is curable by radiation selected from UV and electron beams, or a combination thereof.

6. The method according to claim 1, wherein after curing, the radiation-curable resin is composed of an oligomer selected from the group consisting of an epoxy methacrylate, a silicone methacrylate, a polyester methacrylate and a urethane methacrylate, or a combination thereof.

7. The method according to claim 1 wherein one or more components selected from the group consisting of fire retardants, pigments, UV absorbents, metal whiskers, biocides, bacteriostatic agents, antistatic agents, self-cleaning agents, scratch resistance enhancers, fluorine-containing agents, silicone-containing agents, matting agents, chemical resistance enhancers and liquefiers, or combinations thereof, is added to at least one of the at least two coatings.

8. The method according to claim 1, wherein the base layer of coating liquid applied to the substrate provides adhesion of the coating liquid to the substrate, and impregnation of the coating liquid into the substrate, as a result of which split resistance and moisture resistance are improved.

* * * * *